US012345151B1

(12) United States Patent
Stolboushkin et al.

(10) Patent No.: US 12,345,151 B1
(45) Date of Patent: Jul. 1, 2025

(54) DOWNHOLE SENSOR APPARATUS AND RELATED SYSTEMS, APPARATUS, AND METHODS

(71) Applicant: Baker Hughes Oilfield Operations LLC, Houston, TX (US)

(72) Inventors: Eugene Stolboushkin, Houston, TX (US); Jon David Schroder, The Woodlands, TX (US); Armin Kueck, The Woodlands, TX (US)

( * ) Notice: Subject to any disclaimer, the term of this patent is extended or adjusted under 35 U.S.C. 154(b) by 0 days.

(21) Appl. No.: 18/581,983

(22) Filed: Feb. 20, 2024

(51) Int. Cl.
*E21B 47/013* (2012.01)

(52) U.S. Cl.
CPC ..... *E21B 47/013* (2020.05)

(58) Field of Classification Search
CPC ..... E21B 47/013
See application file for complete search history.

(56) References Cited

U.S. PATENT DOCUMENTS 10,036,241 B2 7/2018 Mcginnis et al.
11,466,559 B2 10/2022 Evans et al.
2006/0065395 A1* 3/2006 Snell ..... E21B 41/0078 175/45
2021/0131263 A1* 5/2021 Dunbar ..... E21B 12/00
2022/0034218 A1 2/2022 Evans et al.
2023/0399939 A1 12/2023 Evans et al.

OTHER PUBLICATIONS

International Search Report and Written Opinion for Application No. PCT/US2025/012071 dated May 13, 2025, 3 pages.
International Written Opinion and Written Opinion for Application No. PCT/US2025/012071 dated May 13, 2025, 5 pages.

* cited by examiner

*Primary Examiner* — Dany E Akakpo
(74) *Attorney, Agent, or Firm* — Baker Hughes Company

(57) ABSTRACT

A downhole sensor apparatus including a structure and an electronics package. The structure and the electronics package configured to be inserted into a recess in an earth-boring tool on a drill string. The downhole sensor apparatus may include a cradle extending away from a first surface of the structure. The cradle is configured to at least partially receive a battery therein. The downhole sensor apparatus includes a cap configured to engage with the earth-boring tool and secure the structure within the recess. The downhole sensor apparatus also may include a ring disposed between the structure and the cap. The ring is configured to transfer a force from the cap to the structure, forcing a second surface of the structure against a bottom surface of the recess. An earth-boring tool comprising a recess in the earth-boring tool configured to receive a downhole sensor apparatus. A method securing a downhole sensor apparatus to an earth-boring tool.

17 Claims, 10 Drawing Sheets

DOWNHOLE SENSOR APPARATUS AND RELATED SYSTEMS, APPARATUS, AND METHODS

TECHNICAL FIELD

Embodiments of the present disclosure generally relate to earth-boring operations. In particular, embodiments of the present disclosure relate to downhole sensors, and related systems, apparatus, and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

The drill string and/or the earth-boring tool may include sensors configured to capture and/or store information acquired downhole. The downhole information may include environmental properties, such as downhole temperature, pressure, etc. In some cases, the downhole information may include operational measurements, such as weight on bit (WOB), rotational speed (RPM), fluid flow rates, etc. In some cases, the downhole information may include formation properties, such as lithology, porosity, strength, etc.

The downhole information may be collected and/or analyzed in real-time or at a later time. For example, the downhole information may be collected through a logging while drilling (LWD) or measuring while drilling (MWD) operation. The downhole information may enable an operator to make decisions, such as a type of earth-boring tool to use, operational decisions, tripping decisions, path decisions, etc. In some cases, the downhole information may be collected in a database configured to predict and/or model future earth-boring operations.

BRIEF SUMMARY

Some embodiments of the present disclosure may include a downhole sensor apparatus. The downhole sensor apparatus may include a structure, an electronics package, a cradle, a cap, and a ring. The structure is configured to be inserted into a recess in an earth-boring tool on a drill string. The electronics package is configured to be inserted into the recess in the earth-boring tool. The cradle may extend away from a first surface of the structure and the cradle may be configured to at least partially receive a battery therein. The cap is configured to engage with the earth-boring tool and secure the structure within the recess. The ring may be disposed between the structure and the cap, and the ring may be configured to transfer a force from the cap to the structure, forcing a second surface of the structure against a bottom surface of the recess.

Another embodiment of the present disclosure may include an earth-boring tool. The earth-boring tool may include a recess in the earth-boring tool, a structure, an electronics package, a cradle, a cap, and a ring. The is configured to be inserted into the recess in an earth-boring tool on a drill string. The electronics package is configured to be inserted into the recess in the earth-boring tool. The cradle may extend away from a first surface of the structure and may be configured to partially receive a battery. The cap may be configured to engage with the tool and secure the structure within the recess. The ring may be disposed between the structure and the cap, and the ring may be configured to transfer a force from the cap to the structure, securing a second surface of the structure to a bottom surface of the recess.

Another embodiment of the present disclosure may include a method of securing a downhole sensor apparatus to an earth-boring tool. The method may include inserting a structure into a recess in an earth-boring tool. The method may include inserting an electronics package into the recess in the earth-boring tool. The method may also include disposing a ring over the structure. The method may further include attaching a cap to the earth-boring tool over the structure by rotating the cap relative to the earth-boring tool and the structure and compressing the ring between the structure and the cap.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

The illustrations presented herein are not meant to be actual views of any particular earth-boring system, sensor, or component thereof but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art. Earth-boring tools may also include tool control components, such as, directional assemblies, stabilizers, motors, steering pads, etc.

As used herein, the term "substantially" in reference to a given parameter means and includes to a degree that one skilled in the art would understand that the given parameter, property, or condition is met with a small degree of variance, such as within acceptable manufacturing or measurement tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

Figure 1:
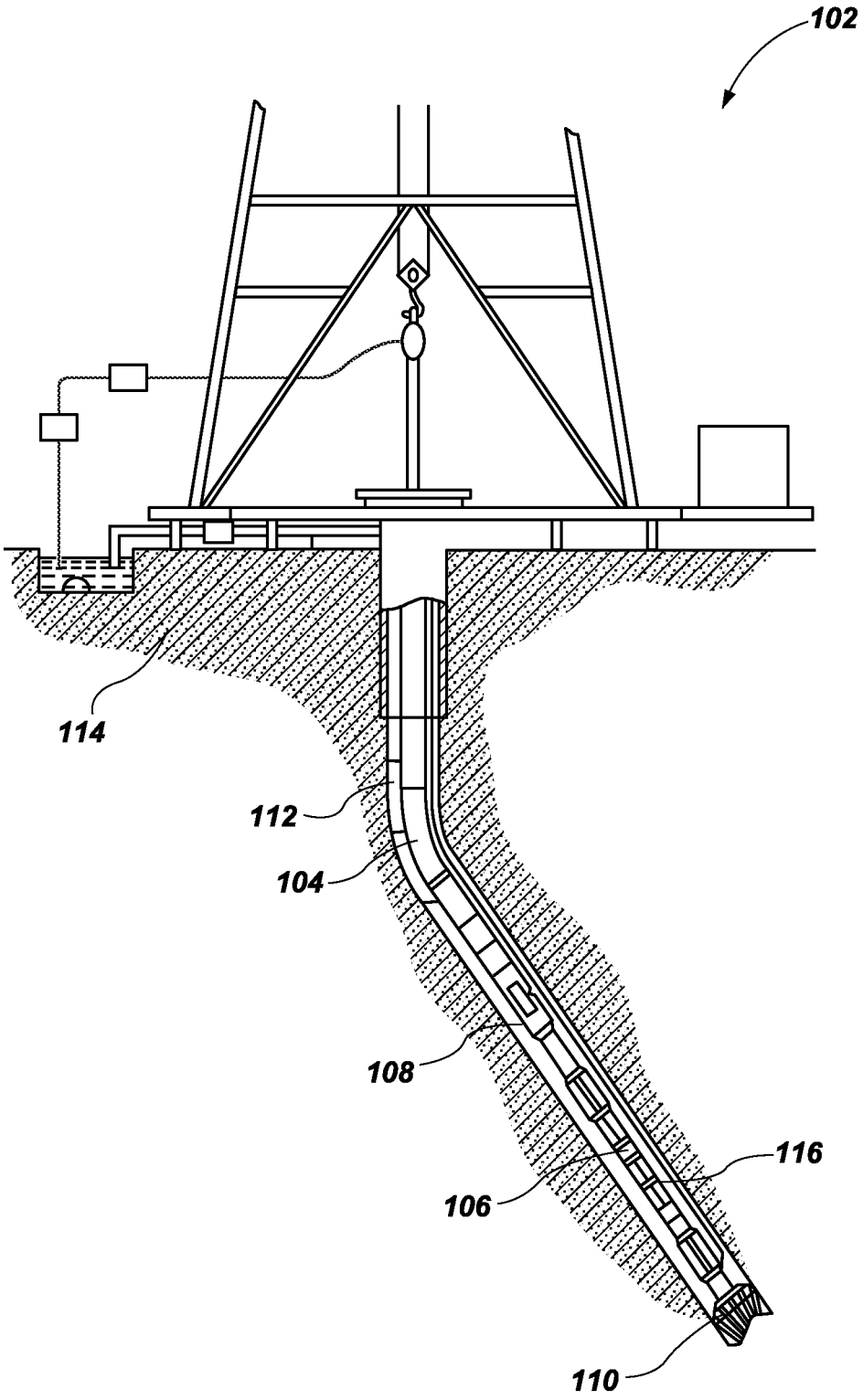
FIG. 1 illustrates an earth-boring system in accordance with an embodiment of the present disclosure.

FIG. 1 illustrates an earth-boring system 102. The earth-boring system 102 includes a drill string 104. The drill string 104 may include multiple sections of drill pipe coupled together to form a long string of drill pipe. In other embodiments, the drill string 104 may comprise what is referred to in the industry as "coiled tubing," and may include a single continuous section of tubing. A forward end of the drill string 104 includes a bottom hole assembly 106 (BHA). The BHA 106 may include components, such as a motor 108 (e.g., mud motor), one or more reamers and/or stabilizers, and an earth-boring tool 110 such as a drill bit. The BHA 106 may also include electronics, such as sensors, modules, and/or tool control components. The drill string 104 may be inserted into a wellbore 112. The wellbore 112 may be formed by the earth-boring tool 110 as the drill string 104 proceeds through a subterranean formation 114. Tool control components may be configured to control an operational aspect of the earth-boring tool 110. For example, the tool control components may include a steering component configured to change an angle of the earth-boring tool 110 with respect to the drill string 104 changing a direction of advancement of the drill string 104. The tool control components may be configured to receive instructions from an operator at the surface and perform actions based on the instructions. In some embodiments, control instructions may be derived downhole within the tool control components, such as in a closed loop system, etc.

The earth-boring system 102 may include at least one downhole sensor apparatus 116. The downhole sensor apparatus 116 may be configured to collect information regarding the downhole conditions such as temperature, pressure, vibration, fluid density, fluid viscosity, cutting density, cutting size, cutting concentration, etc. In some embodiments, the downhole sensor apparatus 116 may be configured to collect information regarding the subterranean formation 114, such as formation composition, formation density, formation geometry, etc. In some embodiments, the downhole sensor apparatus 116 may be configured to collect information regarding the earth-boring tool 110, such as tool temperature, cutter temperature, cutter wear, weight on bit (WOB), torque on bit (TOB), string rotational speed (RPM), drilling fluid pressure at the earth-boring tool 110, fluid flow rate at the earth-boring tool 110, etc.

Figure 2:
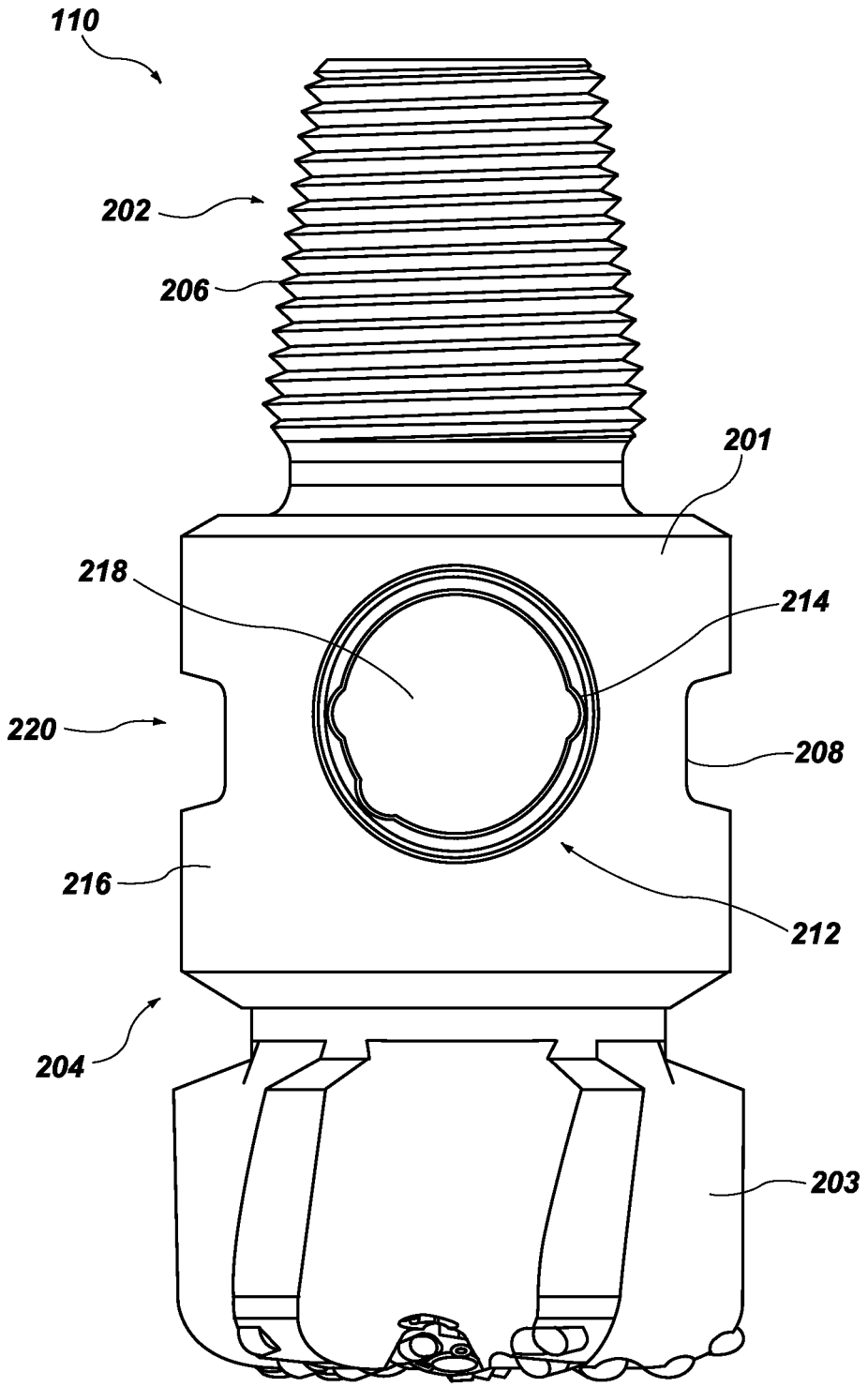
FIG. 2 illustrates a side, elevational view of an earth-boring tool of the earth-boring system of FIG. 1.
Figure 3:
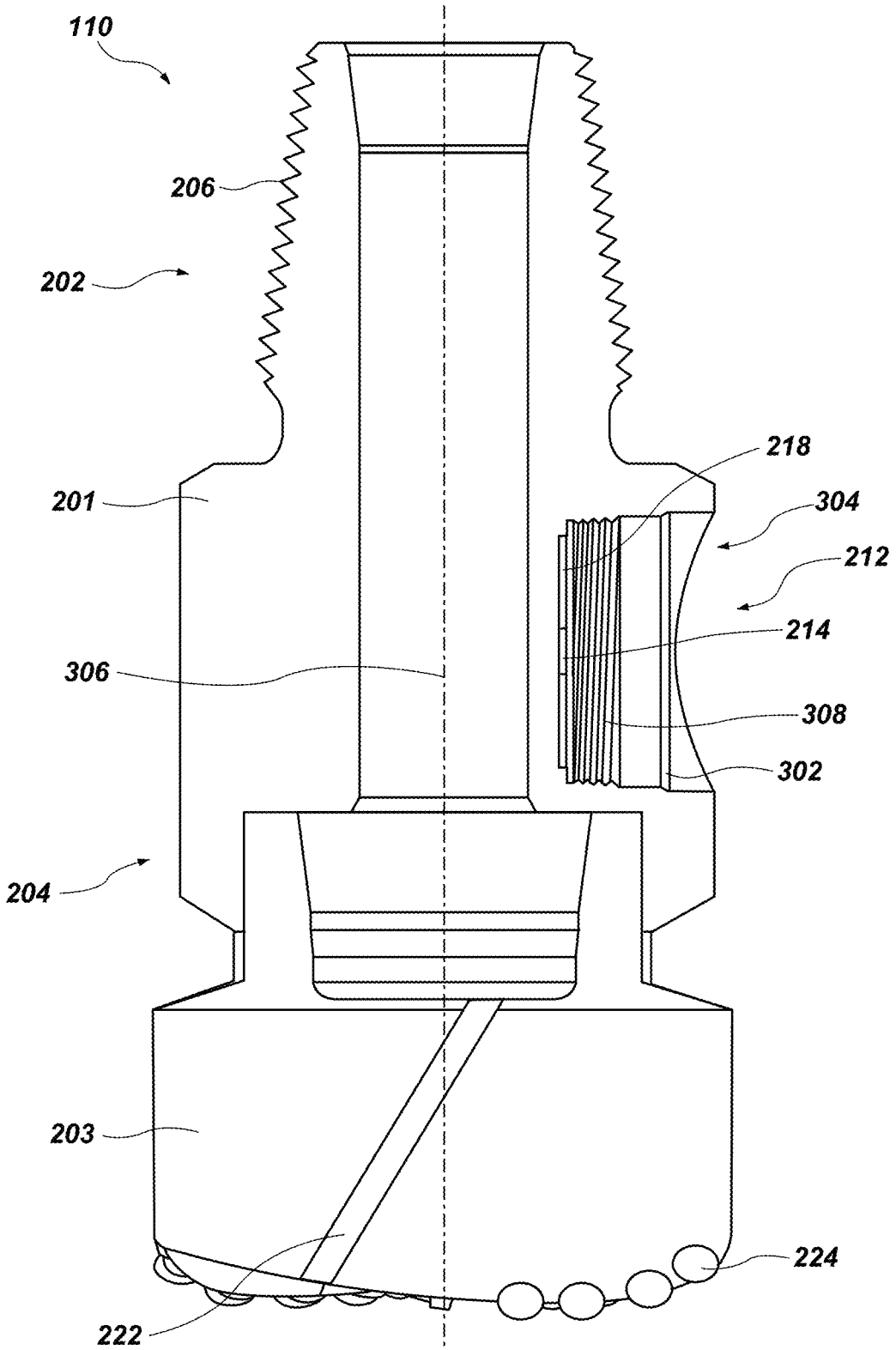
FIG. 3 illustrates a cross-sectional, elevational view of the earth-boring tool of FIG. 2.

FIGS. 2 and 3 show the earth-boring tool 110. The earth-boring tool 110 may include a shank 201 and a bit body 203. The shank 201 may include a first portion 202 and a second portion 204. The first portion 202 may include threads 206. The threads 206 may be configured to connect the earth-boring tool 110 to a section of the drill string 104. The second portion 204 may include a pair of slots 208. The slots 208 may be oriented on opposing sides of the second portion 204 of the earth-boring tool 110. The slots 208 may be configured to aid in connecting the earth-boring tool 110 to the drill string 104 by allowing a tool such as a wrench to engage the slots 208 and rotate the earth-boring tool 110. Rotation of the earth-boring tool 110 relative to the drill string 104 may allow the threads 206 to engage complementary threads in the drill string 104. The second portion 204 is configured to connect the earth-boring tool 110 to another portion of the drill string 104, the bit body 203, cutting elements, or another element configured to contact the subterranean formation 114. In some embodiments, the second portion 204 may be coupled to the bit body or another portion of the drill string by complementary threads, a press fit, a twist and lock insert, a compression connection, welding, soldering, or some combination thereof.

The second portion 204 may include a recess 212 configured to receive a downhole sensor apparatus 116 (FIG. 4) therein, as described in further detail below. In some embodiments, there may be more than one recess 212 and corresponding downhole sensor apparatus 116 in the earth-boring tool 110. In embodiments with more than one recess 212 and more than one downhole sensor apparatus 116, each downhole sensor apparatus 116 may be configured to collect information regarding the downhole conditions such as temperature, pressure, vibration, fluid density, fluid viscosity, cutting density, cutting size, cutting concentration, etc. The downhole sensor apparatus 116 may at least partially exhibit a cross-sectional shape complementary to the recess 212.

The recess 212 may extend at least partially into the second portion 204 of the earth-boring tool 110 from the outer surface 216. The depth of the recess 212 may vary depending on the size of the downhole sensor apparatus 116. The recess 212 may exhibit a substantially cylindrical shape. In some embodiments, the recess 212 may be partially cylindrical and partially have another cross-sectional shape such as rectangular, triangular, elliptical, or some combination thereof such that the cross-sectional shape is complementary to the downhole sensor apparatus 116.

The recess 212 may also include one or more features 214 located near a bottom surface 218 of the recess 212. The features 214 are configured to make the bottom surface 218 exhibit a shape that is not circular. The features 214 may be configured to orient the downhole sensor apparatus 116 relative to the earth-boring tool 110 and to prevent relative, rotational motion between the downhole sensor apparatus 116 and the recess 212. Specific orientation of the downhole sensor apparatus 116 may allow for more accurate data collection in an external downhole environment. In some embodiments, there may be any number of features 214. In the present embodiment, there are three features 214 that exhibit partially circular shapes. In other embodiments, the features 214 may exhibit other shapes such as triangles, squares, or other shapes.

The bit body 203 is configured to contact the subterranean formation 114 during operation of the earth-boring tool 110. The bit body 203 may include a fluid passageway 222 configured to transfer an operational fluid from within the earth-boring tool to the area of subterranean formation 114 where the bit body 203 contacts the subterranean formation 114. The bit body 203 includes at least one cutting element 224 configured to remove at least a portion of the subterranean formation 114 during operation of the earth-boring tool 110.

Referring to FIG. 3, the recess 212 may include an angled surface 302, which has a frustoconical shape in the embodiment shown in the figures. The angled surface 302 may be located proximate to an opening 304 of the recess 212. In the illustrated embodiment, the recess 212 has a larger diameter at the opening 304 and a smaller diameter on the side of the angled surface 302 closer to the longitudinal axis 306 of the earth-boring tool 110. In other embodiments, the angled surface 302 may be located at the interface of the recess 212 and the outer surface 216. As shown in greater detail in FIG. 6, in the cross-sectional plane B, a line 616 that is tangential to the angled surface 302 may intersect a reference line 614 that is parallel to a longitudinal axis 612 of the recess 212. The line 616 and the reference line 614 form an angle 610 within a range of about 25 degrees to about 65 degrees relative to a longitudinal axis 306 of the earth-boring tool 110. In some embodiments, the angle 610 is about 45 degrees. Referring to the cross-sectional plane B shown in FIG. 6, the angled surface 302 may be a substantially flat surface that is parallel to the line 616. In some embodiments, the angled surface 302 may exhibit a concave or convex shape with respect to the line 616. The recess 212 may also include threads 308 near the bottom surface 218 of the recess 212. The threads 308 may be stub acme threads.

Figure 4:
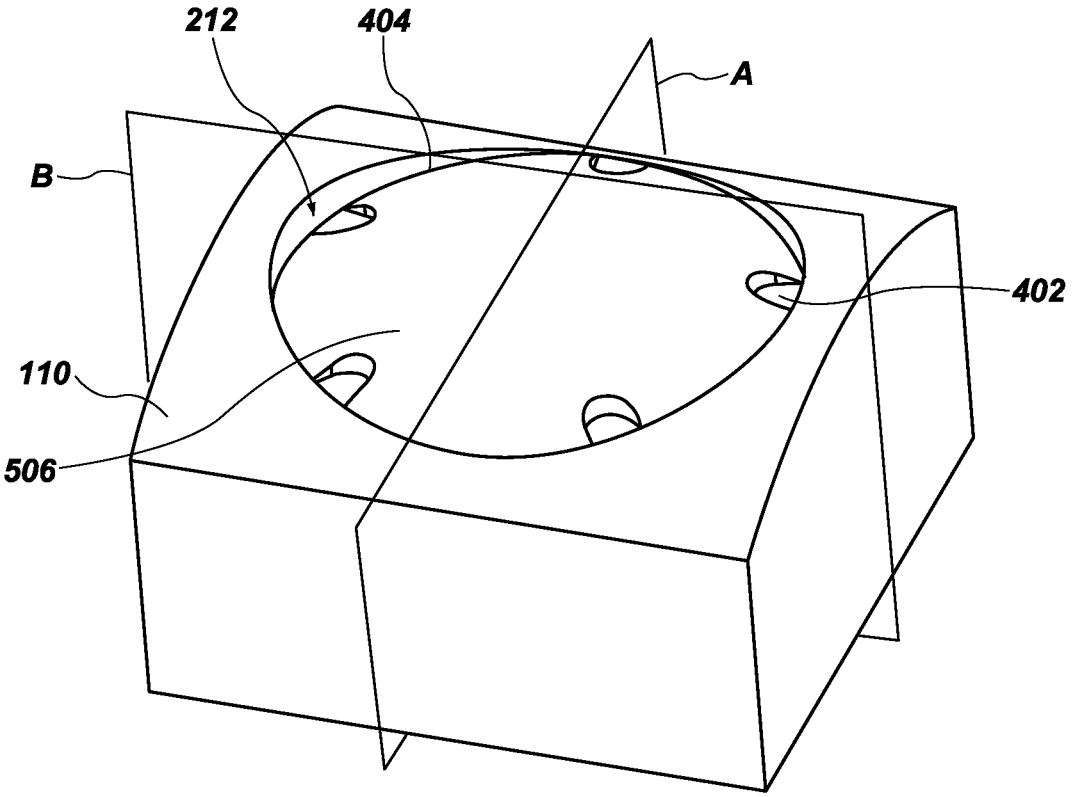
FIG. 4 illustrates a perspective view of a downhole sensor apparatus in a recess of the earth-boring tool of FIGS. 2 and 3.

FIG. 4 illustrates the downhole sensor apparatus 116 secured within the recess 212 of the earth-boring tool 110. As discussed below with regard to FIGS. 5 and 6, the downhole sensor apparatus 116 may include a cap 506 that is rotatable relative to the earth-boring tool 110 and other components of the downhole sensor apparatus 116. The cap 506 may include one or more slots 402. The slots 402 may be configured for engagement with a complementary tool to facilitate assembly and disassembly of the downhole sensor apparatus 116 and the earth-boring tool 110. The slots 402 may be evenly spaced around an outer edge 404 of the cap 506 of the downhole sensor apparatus 116. The cap 506 includes a threaded portion 528 and the recess 212 includes threads 308 that are complementary to the threaded portion 528 of the cap 506. The slots 402 may be configured to engage with the tool to facilitate rotation of the cap 506 to secure the downhole sensor apparatus 116 in the recess 212 of the earth-boring tool 110 through engagement of the threaded portion 528 with the threads 308. The slots 402 may facilitate rotation of the cap 506. Rotating the cap 506 may engage or disengage the cap 506 with the recess 212. Rotating the cap 506 in a clockwise direction may tighten the connection between the cap 506 and the earth-boring tool 110. Rotating the cap 506 in a counter-clockwise direction may loosen the connection between the cap 506 and the earth-boring tool 110.

Figure 5:
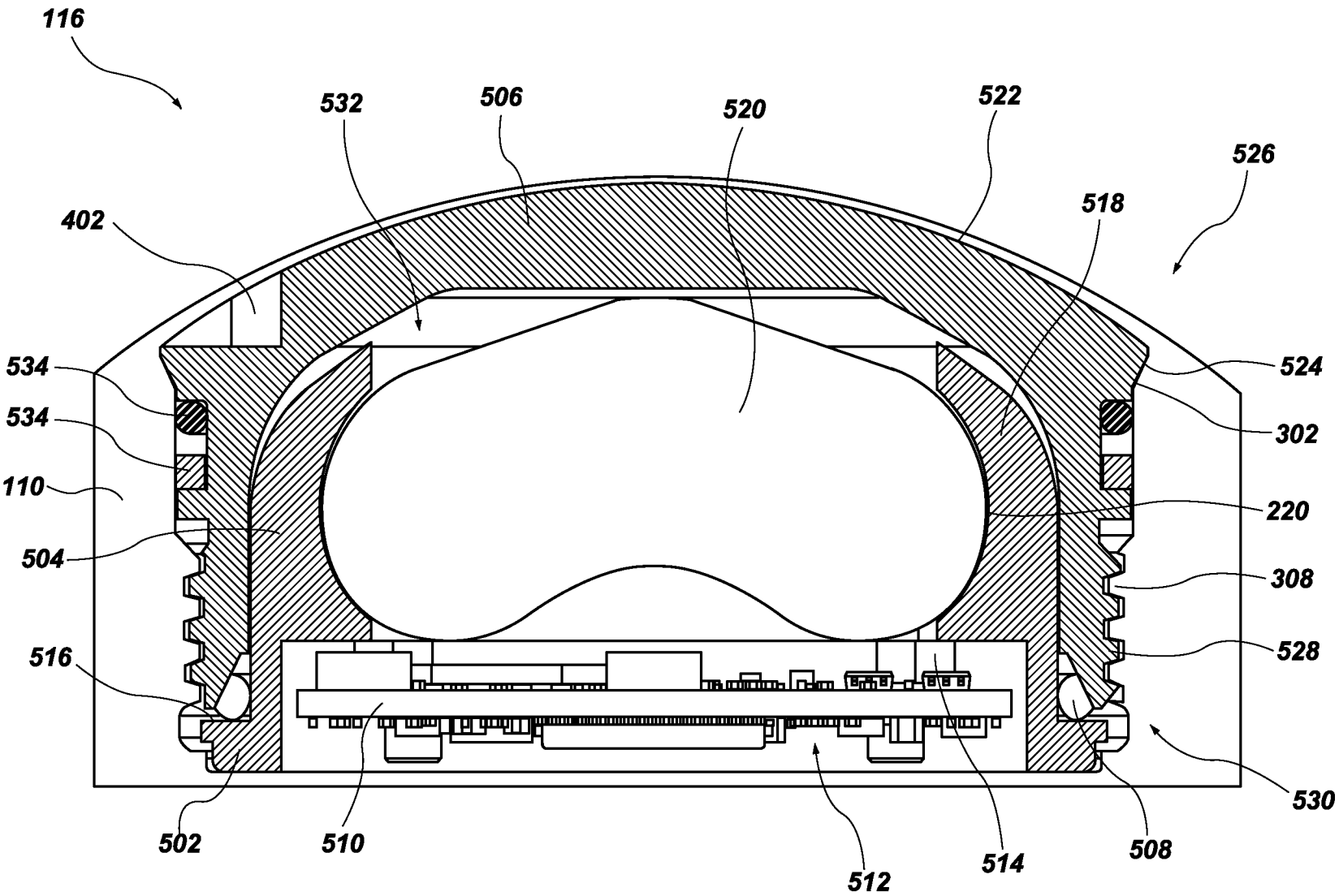
FIG. 5 illustrates a cross-sectional, elevational view of the downhole sensor apparatus taken along plane A in FIG. 4.
Figure 6:
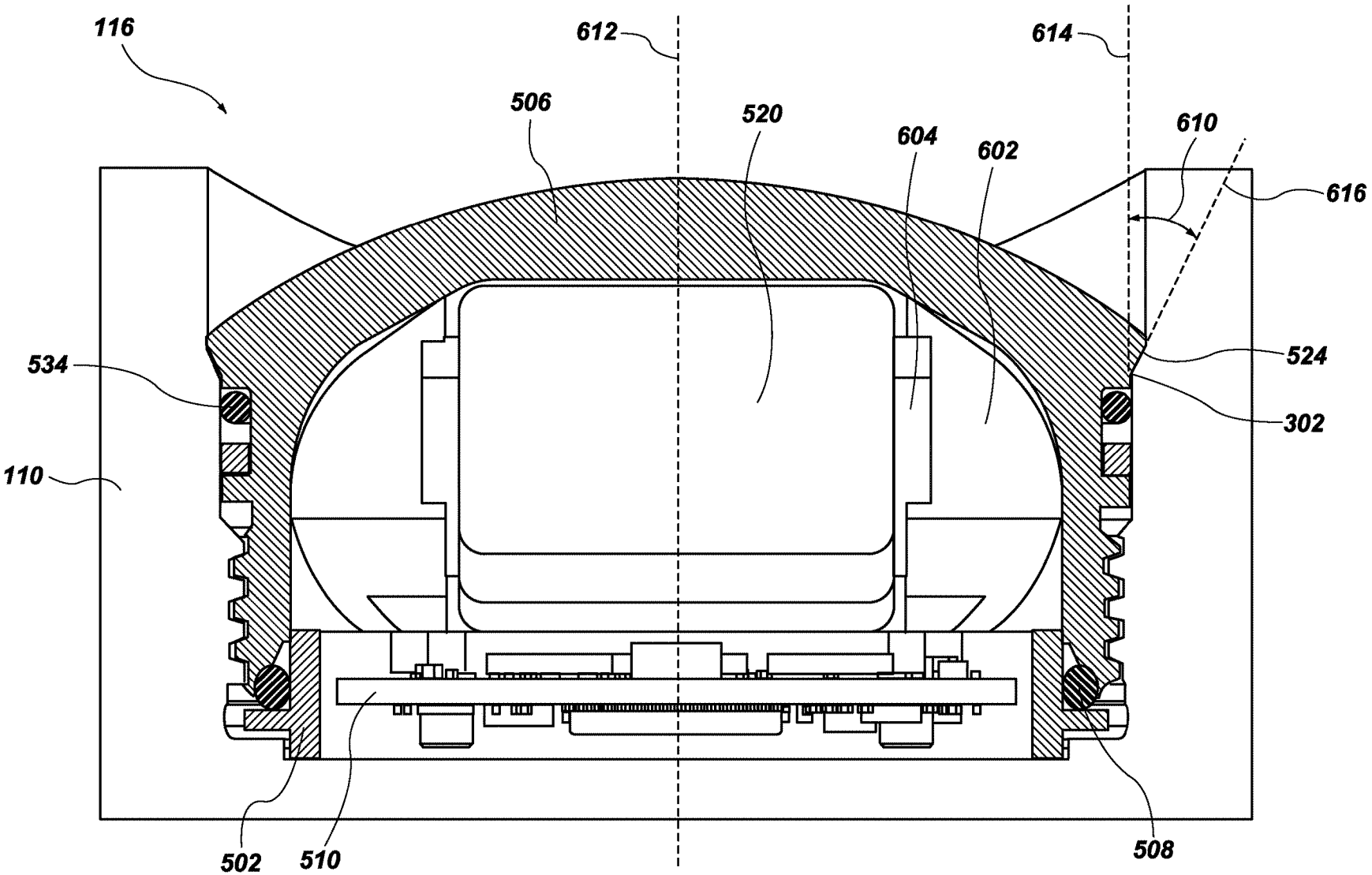
FIG. 6 illustrates a cross-sectional, elevational view of the downhole sensor apparatus taken along plane B in FIG. 4.

Referring to FIGS. 5 and 6, the downhole sensor apparatus 116 may include a structure 502, a cradle 504 extending from the structure 502, a cap 506, and a ring 508. The structure 502 is configured to be inserted into the recess 212 in the earth-boring tool 110 on the drill string 104. In some embodiments, the structure 502 may include multiple sections which may facilitate easier assembly of the downhole sensor apparatus 116. For example, the structure 502 may be divided into two or more sections that correspond to different portions of the structure 502. The structure 502 is also configured to hold an electronics package 510 within the recess 212. The electronics package 510 may include one or more sensors, circuit boards, or other electronic components. The electronics package 510 may be disposed within a cavity 512 of the structure 502 by supports 514. In some embodiments, the electronics package 510 may not be connected to the structure 502. The supports 514 may provide a secure connection between the electronics package 510 and the structure 502. In some embodiments, the electronics package is fixed relative to the structure 502 during operation of the earth-boring system 102. In some embodiments, the supports 514 may be configured to allow some movement of the electronics package 510 due to vibration of the earth-boring tool 110 during operation. The supports 514 may be configured to suspend the electronics package 510 within the cavity 512 such that the electronics package 510 may only be in contact with the supports 514 and no other part of the recess 212 or the structure 502. Suspending the electronics package 510 within the cavity 512 may at least partially isolate the electronics package 510 from any external forces applied to the downhole sensor apparatus 116 during operation of the earth-boring system 102. Isolating the electronics package 510 from external forces applied to the downhole sensor apparatus 116 may improve accuracy of data read and collected by the downhole sensor apparatus 116.

The data collected by the electronics package 510 may be, for example, information regarding the subterranean formation 114, such as formation composition, formation density, formation geometry, etc., and/or information regarding the earth-boring tool 110, such as tool temperature, cutter temperature, cutter wear, weight on bit (WOB), torque on bit (TOB), string rotational speed (RPM), drilling fluid pressure at the earth-boring tool 110, fluid flow rate at the earth-boring tool 110, etc.

The structure 502 may also include a cradle 504 extending away from a first surface 516 of the structure 502. The cradle 504 may include two arms 518 on opposing sides of the structure 502. In other embodiments, there may be more than two arms 518 and the arms 518 may be located on intervals around the sides of the structure 502. The arms 518 are configured to at least partially receive a battery 520. The battery 520 may be configured to provide power to the electronics package 510 during operation of the earth-boring system 102. The arms 518 may include an inner surface 220. The inner surface 220 may exhibit a shape that is substantially complementary to the shape of battery 520. The inner surface 220 may exhibit a substantially concave shape. The cradle 504 may be configured to position the battery 520 relative to the structure 502 such that thermal expansion of the battery 520 may occur without the battery 520 coming into contact with the electronics package 510 or the cap 506.

The cap 506 may include an external surface 522, a tapered surface 524 proximate to a first end 526 of the cap 506, a threaded portion 528 proximate to a second end 530 of the cap 506, and an internal cavity 532. The external surface 522 is configured to be exposed to the external downhole environment. The downhole sensor apparatus 116 is exposed to high temperatures and pressures in the external downhole environment. The cap 506 is configured to transfer at least a portion of the force applied to the external surface 522 from the external downhole environment into the earth-boring tool 110. Specifically, forces may be applied to the external surface 522 of the cap 506 due to the high temperatures and pressures in the external downhole environment. The tapered surface 524 is configured to transfer at least a portion of the force applied to the external surface 522 of the cap 506 into the angled surface 302. The tapered surface 524 is tapered, reducing the overall outer diameter of the cap 506 in the direction from the first end 526 of the cap 506 to the second end 530. The tapered surface 524 is configured to be at an angle that is complementary to the angled surface 302. When the cap 506 is fully connected to the earth-boring tool 110, the tapered surface 524 is in contact with the angled surface 302, facilitating the transfer of the force applied to the external surface 522 into the earth-boring tool 110. Transferring the force applied to the external surface 522 into the earth-boring tool 110 may reduce the force applied to the structure 502. Reducing the forces from the external downhole environment applied to the structure 502 may increase the accuracy of data reading and collection by the downhole sensor apparatus 116.

The threaded portion 528 is configured to secure the cap 506 to the earth-boring tool 110 within the recess 212. The threaded portion 528 of the cap 506 may include stub acme threads and is configured to engage with the threads 308 of the recess 212. The cap 506 may be rotated relative to the recess 212 and the threads 308 may engage with the threaded portion 528 until tapered surface 524 comes into contact with the angled surface 302. The contact between the tapered surface 524 and the angled surface 302 may facilitate a more secure connection between the cap 506 and the earth-boring tool 110. The force transferred between the tapered surface 524 and angled surface 302 may increase a frictional force between the tapered surface 524 and the angled surface 302. The increase in the frictional force may prevent the cap 506 from rotating relative to the earth-boring tool 110 in a counterclockwise direction, thereby preventing loosening of the connection between the cap 506 and the earth-boring tool 110.

The internal cavity 532 is open at the second end 530 of the cap 506 and is configured to be disposed over the structure 502. The internal cavity 532 may be shaped such that the cap 506 may be rotated relative to the structure 502, and there is no mechanical interference between the cap 506 and the structure 502 or the battery 520 as the cap 506 rotates and the threaded portion 528 engages or disengages with the threads 308 of the recess 212.

The downhole sensor apparatus 116 may include one or more seal elements 534. The seal element 534 may be, for example, an O-ring, a rubber seal, metal ring seal, etc. The seal elements 534 are configured to seal the recess 212 from the external downhole environment. The contact between the tapered surface 524 and the angled surface 302 may also at least partially seal the recess 212 from the external downhole environment. The seal between the recess 212 and the external downhole environment may allow for lower pressure and temperature within the internal cavity 532 relative to the external downhole environment. Lower pressure and temperature within the internal cavity 532 may improve efficiency of the downhole sensor apparatus 116 and may improve the lifespan of the electronics package 510, battery 520, and structure 502.

The ring 508 may be configured to be disposed at least partially over the structure 502. In some embodiments, the ring 508 may be integral with the structure 502 or the cap 506. The ring 508 may be disposed over the cradle 504 and contact the first surface 516. The ring 508 is configured to transfer a force from the cap 506 into the first surface 516 of the structure 502. In some embodiments, the ring 508 may include multiple deformable segments and/or deformable posts such as rivets. In some embodiments, the ring 508 may not be present in the downhole sensor apparatus 116. The force transferred into the first surface 516 is configured to press the structure 502 against the bottom surface 218 of the recess 212. The force transferred into the first surface 516 prevents the structure 502 from moving relative to the recess 212 during operation of the earth-boring tool 110.

The ring 508 may be plastically or elastically deformed during assembly of the downhole sensor apparatus 116. The plastic deformation occurs as the cap 506 is tightened over the structure 502. The second end 530 of the cap 506 presses the ring 508 against the first surface 516 thereby causing plastic deformation. Plastic deformation of the ring 508 may increase the force applied to the first surface 516. Plastic deformation of the ring 508 may facilitate an even distribution of the force applied to the first surface 516 by the ring 508. Uneven distribution of the force applied to the first surface 516 may cause distortion in the data collected by the electronics package 510.

Figure 7:
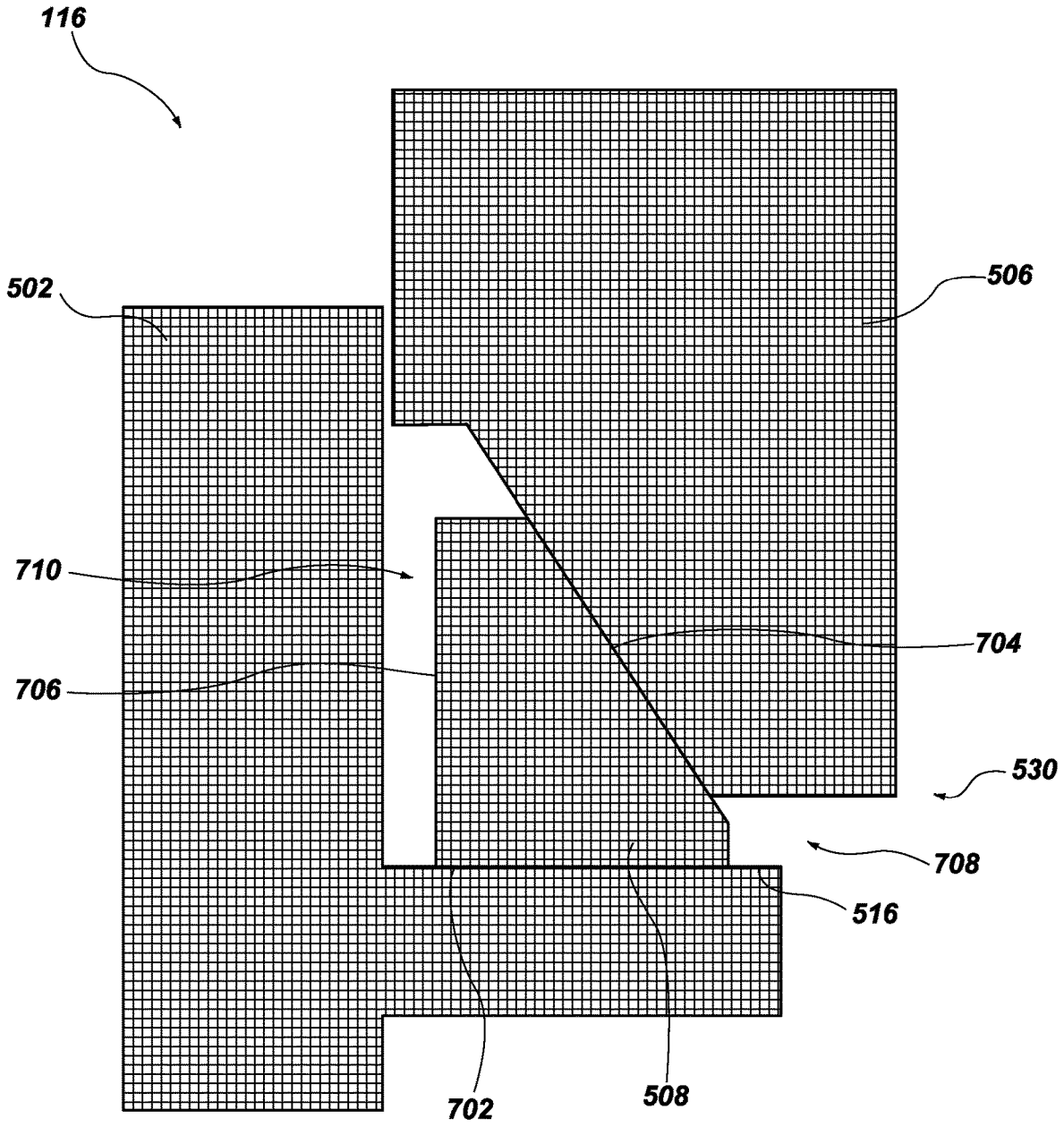
FIG. 7 illustrates a partial, cross-sectional view of the downhole sensor apparatus of FIGS. 5 and 6.

FIG. 7 shows an embodiment of the ring 508. The ring 508 may include a first face 702, a second face 704, and a third face 706. The first face 702 is configured to be in contact with the first surface 516. The second face 704 is configured to contact the second end 530 of the cap 506. The ring 508 may be configured to maintain a gap 708 between the second end 530 of the cap 506 and the first surface 516. There may also be a gap 710 between the third face 706 and the structure 502. The gap 708 between the second end 530 of the cap 506 and the first surface 516 and the gap 710 between the third face 706 and the structure 502 may allow the force applied to the ring 508 to vary without substantially affecting the forces applied to the structure 502. For example, if the cap 506 is displaced in a direction towards the first surface 516, the ring 508 may slide along the first surface 516, making the gap 710 smaller between the third face 706 and the structure 502. The ring 508 may be a plastically deformable material such as steel, titanium, or copper. In other embodiments, the ring 508 may be an O-ring.

Figure 8:
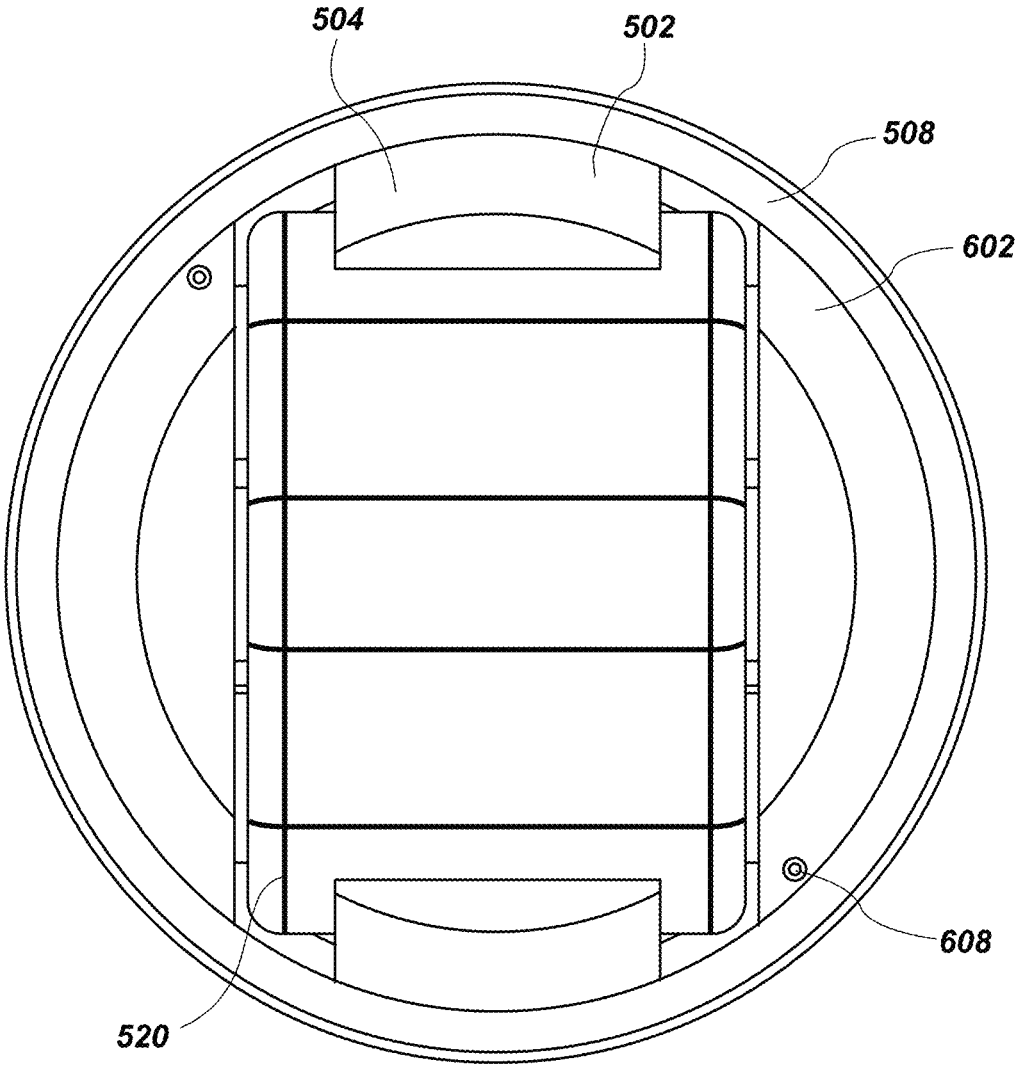
FIG. 8 illustrates a top view of a portion of the downhole sensor apparatus of FIGS. 5 and 6.
Figure 9:
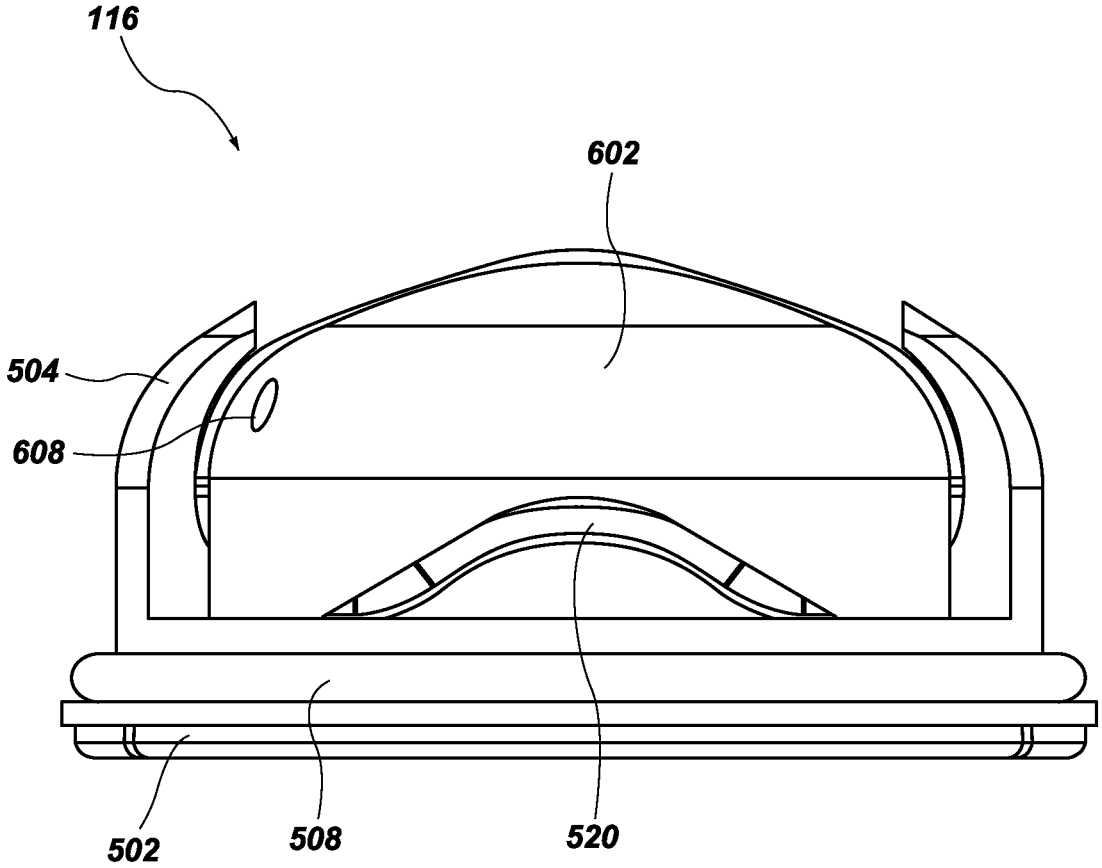
FIG. 9 illustrates a side, elevational view of a portion of the downhole sensor apparatus of FIGS. 5 and 6.

Referring to FIGS. 6, 8, and 9, the downhole sensor apparatus 116 may include one or more retainers 602. The retainers 602 are configured to position the battery 520 within the cradle 504. In some embodiments, there are two retainers 602 on opposing sides of the battery 520. The retainers 602 are positioned such that the arms 518 and the retainers 602 maintain a desired position of the battery 520 relative to the structure 502. The arms 518 are configured to limit the movement of the battery 520 in a first direction, and the retainers 602 are configured to limit the movement of the battery 520 in a second direction that is substantially orthogonal to the first direction, in a plane that is substantially parallel to the bottom surface 218 of the recess 212.

The retainers 602 may include a compressible section 604. The compressible section 604 is configured to allow the battery 520 to have room to expand during operation of the earth-boring system 102 without applying stress to the structure 502. As thermal expansion may cause the battery 520 to expand, the compressible section 604 may be compressed by the battery 520 without displacing the retainer 602. In some embodiments, the compressible section 604 may include multiple sections. The multiple sections of the compressible section 604 may be positioned on the retainer 602 corresponding to points where the battery 520 may exhibit the most thermal expansion.

Each retainer 602 may include an opening 608. The opening 608 is configured to align the retainer 602 in a desired position before the cap 506 is disposed over the structure 502 and retainer 602.

Figure 10:
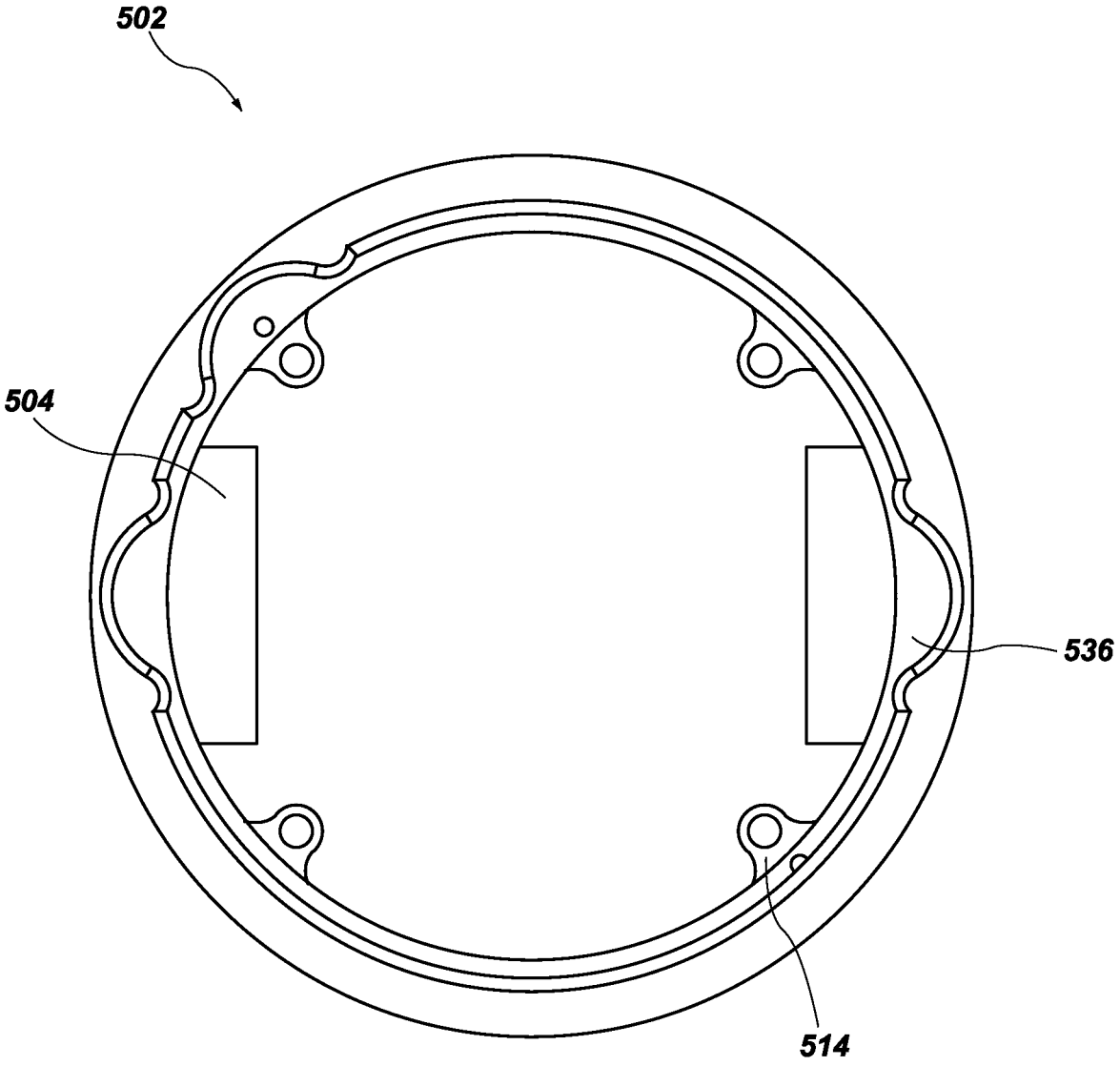
FIG. 10 illustrates a bottom view of a structure of FIGS. 5 and 6.

Referring to FIG. 10, the structure 502 may include one or more features 536. The features 536 may be configured to align with the features 214 in the bottom of the recess 212 to align the structure 502 relative to the earth-boring tool 110. When the structure 502 is inserted into the recess 212, the features 536 of the structure 502 may be received by the features 214 of the recess 212, preventing rotation of the structure 502 relative to the earth-boring tool 110.

Non-limiting example embodiments of the present disclosure may include:

Embodiment 1: A downhole sensor apparatus comprising a structure and an electronics package configured to be inserted into a recess in an earth-boring tool on a drill string. The structure comprises a cradle extending away from a first surface of the structure, the cradle configured to at least partially receive a battery therein. The downhole sensor apparatus comprising a cap configured to engage with the earth-boring tool and secure the structure within the recess and a ring disposed between the structure and the cap, the ring configured to transfer a force from the cap to the structure, forcing a second surface of the structure against a bottom surface of the recess.

Embodiment 2: The downhole sensor apparatus of Embodiment 1, wherein the cap comprises a tapered surface configured to rest on an angled surface within the recess.

Embodiment 3: The downhole sensor apparatus of Embodiment 2, wherein the tapered surface is configured to reduce an axial force transferred from the cap to the structure towards the bottom surface of the recess by transferring the axial force into the earth-boring tool through the angled surface.

Embodiment 4: The downhole sensor apparatus of Embodiment 2 or Embodiment 3, wherein the tapered surface is configured to increase a frictional force between the cap and the angled surface within the recess.

Embodiment 5: The downhole sensor apparatus of any of Embodiments 1-4, wherein the cap is configured to rotate relative to the structure.

Embodiment 6: The downhole sensor apparatus of any of Embodiments 1-5, wherein the ring is configured to be plastically deformed between the structure and the cap.

Embodiment 7: The downhole sensor apparatus of any of Embodiments 1-6, further comprising at least one retainer securing the battery within the cradle.

Embodiment 8: The downhole sensor apparatus of Embodiment 7, wherein the at least one retainer further comprises a compressible section configured to allow the battery to expand during operation of the downhole sensor apparatus.

Embodiment 9: The downhole sensor apparatus of any of Embodiments 1-8, wherein the cradle is configured to maintain a gap between the battery and the electronics package.

Embodiment 10: The downhole sensor apparatus of any of Embodiments 1-9, wherein the cap is axisymmetric.

Embodiment 11: An earth-boring tool comprising a recess in the earth-boring tool, a structure and an electronics package configured to be inserted into the recess in an earth-boring tool on a drill string, a cradle extending away from a first surface of the structure, the cradle configured to partially receive a battery, a cap configured to engage with the tool and secure the structure within the recess, and a ring disposed between the structure and the cap, the ring configured to transfer a force from the cap to the structure, securing a second surface of the structure to a bottom surface of the recess.

Embodiment 12: The earth-boring tool of Embodiment 11, wherein the cap further comprises a tapered surface proximate to a first end of the cap and a threaded portion proximate to a second end of the cap.

Embodiment 13: The earth-boring tool of Embodiment 12, wherein the earth-boring tool comprises an angled surface within the recess complementary to the tapered surface and a threaded portion near the bottom surface of the recess.

Embodiment 14: The earth-boring tool of Embodiment 13, wherein the cap is threadedly connected to the earth-boring tool, and an axial force applied to the external surface of the cap is transferred from the tapered surface into the angled surface increasing the friction therebetween and preventing the cap from rotating relative the earth-boring tool.

Embodiment 15: The earth-boring tool of any of Embodiments 11-14, further comprising a seal element between the cap and the recess configured to seal at least a portion of the recess from an external downhole environment.

Embodiment 16: The earth-boring tool of any of Embodiments 11-15, wherein the structure further comprises at least one feature configured to align the structure with the tool in a desired direction and prevent rotation of the structure within the recess during operation of the earth-boring tool.

Embodiment 17: A method of securing a downhole sensor apparatus to an earth-boring tool, the method comprising inserting a structure and an electronics package into a recess in an earth-boring tool, disposing a ring over the structure, attaching a cap to the earth-boring tool over the structure by rotating the cap relative to the earth-boring tool and the structure, and compressing the ring between the structure and the cap.

Embodiment 18: The method of Embodiment 17, wherein attaching the cap to the earth-boring tool further comprises engaging a threaded portion of the cap with a threaded portion of the earth-boring tool until a tapered surface of the cap contacts an angled surface in the recess.

Embodiment 19: The method of Embodiment 18, further comprising applying a pressure to an external surface of the cap increasing a frictional force between the tapered surface and the angled surface preventing the cap from rotating relative to the earth-boring tool.

Embodiment 20: The method of any of Embodiments 17-19, further comprising disposing a battery within a cradle on the structure and disposing at least one retainer on the structure to secure the battery within the cradle, the at least one retainer comprising a compressible section.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A downhole sensor apparatus comprising:

a structure configured to be inserted into a recess in an earth-boring tool on a drill string;

an electronics package configured to be inserted into the recess in the earth-boring tool;

a cradle extending away from a first surface of the structure, the cradle configured to at least partially receive a battery therein;

a cap configured to engage with the earth-boring tool and secure the structure within the recess, wherein the cap comprises a tapered surface proximate to a first end of the cap configured to rest on an angled surface within the recess, the tapered surface separate from a threaded portion proximate to a second end of the cap; and a ring disposed between the structure and the cap, the ring configured to transfer a force from the cap to the structure, forcing a second surface of the structure against a bottom surface of the recess.

2. The downhole sensor apparatus of claim 1, wherein the tapered surface is configured to reduce an axial force transferred from the cap to the structure towards the bottom surface of the recess by transferring the axial force into the earth-boring tool through the angled surface.

3. The downhole sensor apparatus of claim 1, wherein the tapered surface is configured to increase a frictional force between the cap and the angled surface within the recess.

4. The downhole sensor apparatus of claim 1, wherein the cap is configured to rotate relative to the structure.

5. The downhole sensor apparatus of claim 1, wherein the cradle is configured to maintain a gap between the battery and the electronics package.

6. The downhole sensor apparatus of claim 1, wherein the cap is axisymmetric.

7. A downhole sensor apparatus comprising:

a structure configured to be inserted into a recess in an earth-boring tool on a drill string;

an electronics package configured to be inserted into the recess in the earth-boring tool;

a cradle extending away from a first surface of the structure, the cradle configured to at least partially receive a battery therein;

a cap configured to engage with the earth-boring tool and secure the structure within the recess, wherein the cap comprises a tapered surface proximate to a first end of the cap configured to rest on an angled surface within the recess, the tapered surface separate from a threaded portion proximate to a second end of the cap; and a ring disposed between the structure and the cap, the ring configured to transfer a force from the cap to the structure, forcing a second surface of the structure against a bottom surface of the recess, the ring configured to be plastically deformed between the structure and the cap.

8. A downhole sensor apparatus comprising:

a structure configured to be inserted into a recess in an earth-boring tool on a drill string;

an electronics package configured to be inserted into the recess in the earth-boring tool;

a cradle extending away from a first surface of the structure, the cradle configured to at least partially receive a battery therein, and at least one retainer securing the battery within the cradle;

a cap configured to engage with the earth-boring tool and secure the structure within the recess, wherein the cap comprises a tapered surface proximate to a first end of the cap configured to rest on an angled surface within the recess, the tapered surface separate from a threaded portion proximate to a second end of the cap; and a ring disposed between the structure and the cap, the ring configured to transfer a force from the cap to the structure, forcing a second surface of the structure against a bottom surface of the recess.

9. The downhole sensor apparatus of claim 7, wherein the at least one retainer further comprises a compressible section configured to allow the battery to expand during operation of the downhole sensor apparatus.

10. An earth-boring tool comprising:

a recess in the earth-boring tool;

a structure configured to be inserted into the recess in an earth-boring tool on a drill string;

an electronics package configured to be inserted into the recess in the earth-boring tool;

a cradle extending away from a first surface of the structure, the cradle configured to partially receive a battery;

a cap configured to engage with the tool and secure the structure within the recess, wherein the cap comprises:

a tapered surface proximate to a first end of the cap, and a threaded portion proximate to a second end of the cap; and a ring disposed between the structure and the cap, the ring configured to transfer a force from the cap to the structure, securing a second surface of the structure to a bottom surface of the recess.

11. The earth-boring tool of claim 10, wherein the earth-boring tool comprises:

an angled surface within the recess complementary to the tapered surface;

and a threaded portion near the bottom surface of the recess.

12. The earth-boring tool of claim 11, wherein the cap is threadedly connected to the earth-boring tool, and an axial force applied to an external surface of the cap is transferred from the tapered surface into the angled surface increasing the friction therebetween and preventing the cap from rotating relative the earth-boring tool.

13. The earth-boring tool of claim 10, further comprising a seal element between the cap and the recess configured to seal at least a portion of the recess from an external downhole environment.

14. The earth-boring tool of claim 10, wherein the structure further comprises at least one feature configured to align the structure with the tool in a desired direction and prevent rotation of the structure within the recess during operation of the earth-boring tool.

15. A method of securing a downhole sensor apparatus to an earth-boring tool, the method comprising:

inserting a structure and an electronics package into a recess in an earth-boring tool;

disposing a ring over the structure;

attaching a cap to the earth-boring tool over the structure by rotating the cap relative to the earth-boring tool and the structure, wherein attaching the cap to the earth-boring tool further comprises engaging a threaded portion of the cap with a threaded portion of the earth-boring tool until a tapered surface of the cap contacts an angled surface in the recess; and compressing the ring between the structure and the cap.

16. The method of claim 15, further comprising applying a pressure to an external surface of the cap increasing a frictional force between the tapered surface and the angled surface preventing the cap from rotating relative to the earth-boring tool.

17. The method of claim 15, further comprising:

disposing a battery within a cradle on the structure; and disposing at least one retainer on the structure to secure the battery within the cradle, the at least one retainer comprising a compressible section.

* * * * *